US006363317B1

(12) United States Patent
Druzhinina et al.

(10) Patent No.: US 6,363,317 B1
(45) Date of Patent: Mar. 26, 2002

(54) CALIBRATION METHOD FOR DISC ENGINES

(75) Inventors: Maria Druzhinina, Dearborn; Ilya Vladimir Kolmanovsky, Ypsilanti, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/648,608

(22) Filed: Aug. 26, 2000

(51) Int. Cl.[7] ..... F02B 17/00
(52) U.S. Cl. ..... 701/104; 123/295
(58) Field of Search ..... 701/104, 102, 701/110, 114; 123/295, 299, 305, 430, 480

(56) References Cited

U.S. PATENT DOCUMENTS

| | | | | |
|---|---|---|---|---|
| 5,157,613 A | | 10/1992 | Williams et al. | |
| 5,558,064 A | | 9/1996 | Buslepp | |
| 5,577,474 A | | 11/1996 | Livshiz et al. | |
| 5,947,079 A | * | 9/1999 | Sivashankar et al. | 123/295 |
| 6,026,779 A | * | 2/2000 | Obata et al. | 123/295 |
| 6,039,025 A | * | 3/2000 | Iwano et al. | 123/399 |
| 6,253,546 B1 | * | 7/2001 | Sun et al. | 701/109 |

FOREIGN PATENT DOCUMENTS

| | | | | |
|---|---|---|---|---|
| JP | 2001-73830 | * | 3/2001 | F02D/41/02 |

* cited by examiner

*Primary Examiner*—John Kwon
*Assistant Examiner*—Hieu T. Vo
(74) *Attorney, Agent, or Firm*—Carlos L. Hanze

(57) ABSTRACT

A method of mapping a direct injection stratified charge (DISC) engine comprises the steps of generating an estimated fueling rate map and torque map from engine steady-state mapping data, generating a transient engine operating trajectory along a predetermined parameter vector toward an associated desired torque, and iteratively modifying the estimated fueling rate map as a function of the generated torque resulting from the transient engine operating trajectory. In one aspect of the present method, the step of iteratively modifying the estimated fueling rate map includes updating the fueling map at each sampling time instant ($t_k$) by applying a current estimated fueling rate associated with the estimated fueling rate map, and determining the engine torque value corresponding to the parameter vector. The torque value is then inverted to update the fueling map as a function of the engine torque value. The method is advantageous because it reduces the time to map a DISC engine torque strategy because calibration is performed with transient engine response data rather than steady-state data.

13 Claims, 2 Drawing Sheets

CALIBRATION METHOD FOR DISC ENGINES

TECHNICAL FIELD

The present invention relates to engine modeling and control and more particularly to a method of calibrating a direct injection stratified charge (DISC) engine.

BACKGROUND OF THE INVENTION

Gasoline DISC engine technology has the potential of improving fuel economy through the use of stratified combustion, which significantly extends the lean burn limit and reduces pumping losses in the engine. Compared with a conventional port fuel injection (PFI) gasoline engine, a DISC engine is much more complicated in its hardware and operating strategy. Like a PFI engine, a DISC engine consists of an intake manifold, combustion chambers, and an exhaust system. Its hardware design and configuration, however, are different from a PFI engine in several key aspects. The location of injectors is different. In a DISC engine, fuel is injected directly into the cylinder as opposed to the intake port. The fueling system also differs. A high pressure fueling system is an important aspect of the DISC technology and is operated at a pressure that is 10–15 times higher than that of a PFI fueling system. The combustion chamber configuration of DISC engines also include non-flat piston heads having deliberately designed cavities to ensure charge stratification. The after-treatment package of a DISC engine typically requires the combination of a three-way catalyst (TWC) and a lean $NO_x$ trap (LNT) to meet emission standards.

With the special piston design and the high pressure fueling system, a DISC engine can effect two distinct modes of operation by properly timing the fuel injection in relation to other engine events. By injecting early in the intake stroke, there is enough time for the mixing of air and fuel to form a homogeneous charge by the time the ignition event is initiated. on the other hand, by injecting late in the compression stroke, the special combustion chamber design and the piston motion will lead to the formation of a stratified charge mixture that is overall very lean, but rich around the spark plug. In a typical DISC engine, a properly positioned swirl control valve can also contribute to enforcing the stratification in one mode and assuring good mixing in another.

The torque and emission characteristics corresponding to these two modes are so distinct that different strategies are required to optimize the engine performance in these different modes. Furthermore, in addition to the standard engine control variables such as throttle, fueling rate, spark timing and exhaust gas recirculation (EGR), other inputs, such as injection timing, fuel rail pressure and swirl control valve setting are also available.

The increased system complexity, coupled with more stringent fuel economy and emissions requirements, has made the DISC engine a control-intensive technology which depends heavily on the control system to deliver its expected benefits. Given the multitude of control inputs and performance indices, such as fuel consumption, emissions and other driveability measures, DISC engine control strategy development and system optimization rely heavily on model-based approaches and computer aided control design tools.

In particular, the development of calibration tables or engine maps for DISC engines is very time consuming. An engine sweep at a single engine speed/engine load operating point may require tens of thousands of steady-state mapping points. Each point requires stabilized engine conditions that may take several minutes to achieve. Thus, any hardware changes which result in the need to recalibrate the engine operating tables results in significant delay. Thus, there exists a need for alternative procedures that reduce the time and effort necessary to calibrate an engine strategy.

SUMMARY OF THE INVENTION

It is an object of the present invention to provide an improved method of calibrating a direct injection stratified charge engine.

The foregoing and other objects are attained by a method of calibrating a direct injection stratified charge (DISC) engine. The method comprises the steps of generating an estimated fueling rate map and torque map from engine steady-state mapping data, generating a transient engine operating trajectory along a predetermined parameter vector toward an associated desired torque, and iteratively modifying the estimated fueling rate map as a function of the generated torque resulting from the transient engine operating trajectory. In one aspect of the present method, the step of iteratively modifying the estimated fueling rate map includes updating the fueling map at each sampling time instant ($t_k$) by applying a current estimated fueling rate associated with the estimated fueling rate map, and determining the engine torque value corresponding to the parameter vector. The torque value is then inverted to update the fueling map as a function of the engine torque value.

An advantage of the present invention is that it reduces the time to calibrate or map an engine torque strategy because calibration is performed with transient engine response data. The present invention also reduces calibration effort because the calibrator does not have to develop and identify detailed and accurate representation for the torque map and fueling map, as these are automatically generated during the course of the adaptation.

The present invention is also advantageous in that it increases the accuracy with which the desired torque is delivered.

Other objects and advantages of the invention will become apparent upon reading the following detailed description and appended claims, and upon reference to the accompanying drawings.

BRIEF DESCRIPTION OF THE DRAWINGS

For a more complete understanding of this invention, reference should now be had to the embodiments illustrated in greater detail in the accompanying drawings and described below by way of examples of the invention. In the drawings.

DETAILED DESCRIPTION OF THE PREFERRED EMBODIMENT(S)

Figure 1:
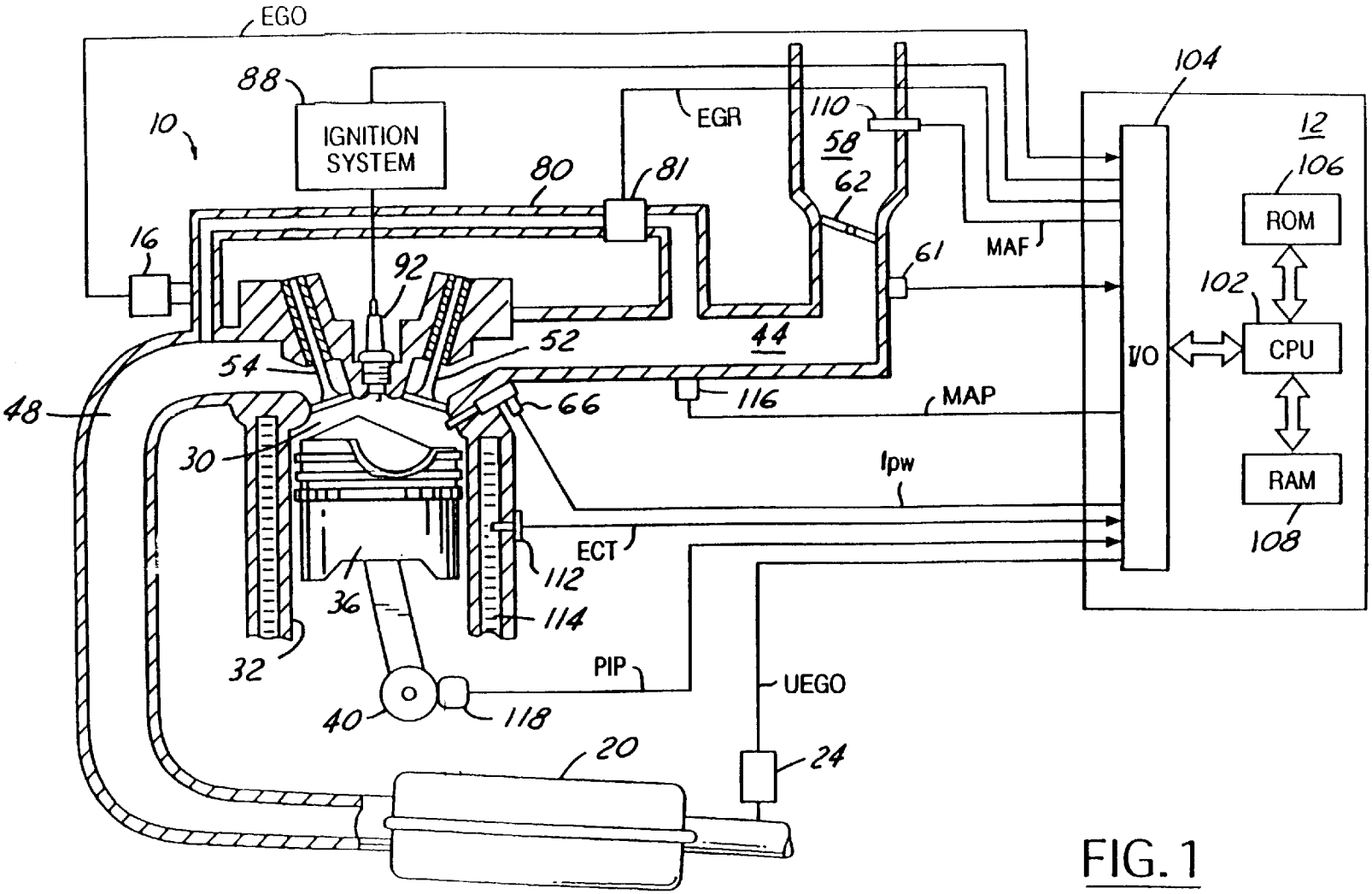
FIG. 1 is a block diagram of a DISC engine system where the present invention may be used to advantage.

Referring now to FIG. 1, there is shown a block diagram of a DISC engine system. The DISC engine system includes the engine 10 comprising a plurality of cylinders, one cylinder of which shown in FIG. 1, is controlled by an electronic engine controller 12. In general, controller 12 controls the engine air fuel (timing and quality), spark, EGR, etc., as a function of the output of sensors such as exhaust gas oxygen sensor 16 and proportional exhaust gas oxygen sensor 24. Continuing with FIG. 1, engine 10 includes a combustion chamber 30 and cylinder walls 32 with piston 36 positioned therein and connected to a crankshaft 40. Combustion chamber 30 is shown communicating with intake manifold 44 and exhaust manifold 48 via respective intake valve 52 and exhaust valve 54. Intake manifold 44 is shown communicating with throttle body 58 via throttle plate 62. Preferably, throttle plate 62 is electronically controlled via drive motor 61. The combustion chamber 30 is also shown communicating with a high pressure fuel injector 66 for delivering fuel in proportion to the pulse width of signal FPW from controller 12. Fuel is delivered to the fuel injector 66 by a fuel system (not shown) which includes a fuel tank, fuel pump, and high pressure fuel rail.

The ignition system 88 provides ignition spark to the combustion chamber 30 via the spark plug 92 in response to the controller 12.

Controller 12 as shown in FIG. 1 is a conventional microcomputer including a microprocessor unit 102, input/output ports 104, read-only memory 106, random access memory 108, and a conventional data bus. Controller 12 is shown receiving various signals from sensors coupled to the engine 10, in addition to those signals previously discussed, including: measurements of inducted mass airflow (MAF) from mass airflow sensor 110, coupled to the throttle body 58; engine coolant temperature (ECT) from temperature sensor 112 coupled to the cooling sleeve 114; a measurement of manifold pressure (MAP) from manifold sensor 116 coupled to intake manifold 44; and a profile ignition pickup signal (PIP) from Hall effect sensor 118 coupled to crankshaft 40.

The DISC engine system of FIG. 1 also includes a conduit 80 connecting the exhaust manifold 48 to the intake manifold 44 for exhaust gas recirculation (EGR). Exhaust gas recirculation is controlled by EGR valve 81 in response to signal EGR from controller 12.

The DISC engine system of FIG. 1 further includes an exhaust gas after-treatment system 20 which includes a three-way catalyst (TWC) and a lean $NO_x$, trap (LNT).

In operation, the engine torque T, depends on the engine fueling rate, ($W_f$), engine spark timing, s, the intake manifold pressure ($P_1$), the burnt gas fraction in the intake manifold ($F_1$), and the mass flow rate into the cylinders ($W_{cyl}$). The functional dependence is different for the stratified and the homogeneous combustion modes:

$$T=T_s(W_f,p_1,s,F_1,N), \text{ in stratified combustion mode,}$$

$$T=T_h(W_f,p_1,s,F_1,N), \text{ in homogeneous combustion mode.} \quad (1)$$

To deliver the desired value of the torque output, $T_d$, the torque functions (1) is inverted. Specifically, the fueling rate value is generated according to $$W_f=L_s(T_d,p_1,s,F_2,N,W_{cyl}), \text{ in stratified combustion mode,}$$

$$W_f=L_h(T_d,p_1,s,F_1,N,W_{cyl}), \text{ in homogeneous combustion mode.} \quad (2)$$

such that the torque value of $T_d$ for the given s, $P_1$, N and $F_1$ is achieved. The variables $F_1$, $W_{cyl}$ are estimated by the air-charge feature while the remaining variables are measured from sensors.

In general, the amount of charge inducted into a cylinder in one intake event ($120W_{cyl}/(nN)$), where n is the number of cylinders) is proportional to the intake manifold pressure. Other variables, such as the engine speed (N) and the intake manifold temperature ($t_i$) also affect the pumping performance and volumetric efficiency. Based on observations of engine mapping data for many different engines, including DISC engines, the following static regression equation was used to represent the engine pumping rate:

$$W_{cyl}=(f_0^1+f_1^1N+f_2^1t_i30\ f_3^1P_i+f_4^1NP_i++f_5^1t_iP_i)N \quad (3)$$

where $f_i^1 \cdot i=0, \ldots, 5$ are coefficients which are determined by regressing the test data using least squares or other curve fitting techniques. The intake manifold temperature depends on the air mass flow and EGR as determined by the function:

$$t_i=f_0^2+f_1^2E+f_2^2Wa+f_3^2E^2+f_4^2EW_a\ f_5^2W_a^2 \quad (4)$$

with E being the mass percentage of EGR.

Equations (1) and (2) provide the engine maps for torque and fueling rate. These engine maps are determined first by initially approximating the maps (1) and (2) from the available steady-state mapping data. This approximation may not and does not have to be accurate. Second, using the adaptive algorithm described next, the maps are fine tuned from the data obtained by driving the engine through various transient trajectories.

The following describes an adaptive/self-tuning algorithm used to increase the accuracy of the torque and fueling rate maps. The algorithm assumes that the engine torque is measured or estimated (e.g., from in-cylinder pressure measurements).

$T(W_f, v)$ represents the true map, measured by the torque sensor in the calibration vehicle or on the engine dynamometer, where $v=[p_1,N,S,W_{cyl},F_1]$ is a parameter vector estimated by the aircharge feature which has been fully calibrated already.

$T_0(W_f, v)$ represents the initial torque approximation developed based on regressing steady-state engine mapping data in the first step above, and $W_{f,0}(T_d,v)$ is its inverse (i.e., the fueling map).

It is desirable to adapt the fueling map on-line so that $$W_f(T_d, v)=W_{f,0}(T_d, v)+\underline{W}_f(T_d, v),$$

$$T(W_f(T_d, v),v)=T_d \quad (5)$$

Note that the function T is unknown but can be "measured" at the specified $T_d$, v.

The following is substituted as a representation for $\underline{W}_f(T_d,v)$ in the form of a linearly-parametrized functional expansion $$\underline{W}_f(T_d, v)=\sum_{i=1}^{n}\lambda_i\Phi_i(T_d, v) \quad (6)$$

where $\Phi_i$ are specified basis functions such as polinomials or neural networks. The table look-up is incorporated by selecting $\Phi_i$ as multidimensional B-splines. The values of $\lambda_i$ are updated on-line.

Assuming that at a time instant t=kT the applied fueling rate $\underline{W}_f^k$,results in a measured torque value $T^k=T(\underline{W}_f^k,v^k)$ Then, an update $\underline{W}_f^{k+1}$ is constructed to be applied at the time-instant t=(k+1)T, (assuming $v^{k+1}=v^k$) in the following form:

$$\underline{W}_f^{k+1}=\underline{W}_f^k+\Delta\underline{W}_f^k \quad (7)$$

By choosing $\Delta\underline{W}_f^k$ in (7) , it minimizes at each iteration the following criterion J:

$$J = \frac{1}{2}\left\|T(W_f^k + \Delta\underline{W}_f^k, v^k) - T_d\right\|^2 + \frac{1}{2}r\left\|\Delta\underline{W}_f^k\right\|^2 \rightarrow \min, \tag{8}$$

where $W_f^k = \underline{W}_f^k + W_{f,0}(T_d, v^k)$.

If the gradient of $T(W_f^k, V^k)$ with respect to $W_f$, i.e., $D_1T(W_f^k, V^k)$, is known (it will be estimated later), then, if $|\Delta\underline{W}_f^k|$ is small, a linear approximation is valid and the minimization problem takes the form $$J = \frac{1}{2}\left\|T(W_f^k, v^k) + D_1T(W_f^k, v^k)\Delta\underline{W}_f^k - T_d\right\|^2 + \frac{1}{2}T\left\|\Delta\underline{W}_f^k\right\|^2 \rightarrow \min. \tag{9}$$

If the derivative is set to zero, the necessary condition for the minimum is obtained in the form:

$$(T(W_f^k v^k) + D_1T\Delta\underline{W}_f^k - T_d)D_1T + r\Delta\underline{W}_f^k = 0, \tag{10}$$

or $$\Delta\underline{W}_f^k = \frac{-(T(W_f^k, v^k) - T_d)D_1T}{r + (D_1T)^2}, \tag{11}$$

where $D_1T = D_1T(W_f^k v^k)$.

The number $\Delta\underline{W}_f^k$ is now used to update the parameters in the representation (6) of $\underline{W}_f(T_d, v)$. Interpreting the generated vector $\underline{W}_f^{k+1} = \underline{W}_f^k + \Delta\underline{W}_f^k$ as a "new measurement" of the function (6), the process successively generates an approximation of the unknown parameter $\lambda$ at the time $t=(k+1)T$ according to the following projection algorithm:

$$\lambda^{k+1} = \lambda^k + \Delta\lambda^k, \tag{12}$$

$$\Delta\lambda^k = \frac{y\Phi^T(T_d, v^k)a_k}{a + \Phi(T_d, v^k)\Phi^T(T_d, v^k)}\left(\underline{W}_f^k(T_d, v_k) + \Delta\underline{W}_f^k - \Phi(T_d, v^k)\lambda^k\right),$$

where $a>0$, $0<y<2$, and $a_k$ is a dead-band parameter.

The following discussion develops an on-line approximation for the gradient $D_1T$. By analogy with the representation form (5), (6) for the fueling rate, $W_f$, the following represents the torque $T(W_f, v)$:

$$T(W_f, v) = T_o(W_f, v) + \sum_{i=1}^{m}\theta_i H_i(W_f, v) = H(W_f, v)\theta, \tag{13}$$

where $H=(H_1, \ldots, H_m)$ is a row-vector of specified basis functions. The derivative of the torque (13) with respect to the fuel rate $W_f$ has the following form:

$$D_1T(W_f, v) = \tag{14}$$

$$D_1T_0(W_f, v) + \sum_{i=1}^{m}\theta_i D_1H_i(W_f, v) = D_1T_0(W_f, v) + D_1H(W_f, v)\theta.$$

In order to get the estimate (14), the value of $\theta$ is updated on-line using the following projection algorithm:

$$\theta^{k+1} = \theta^k + \Delta\theta^k, \tag{15}$$

$$\Delta\theta^k = \frac{yH^T(W_f^k, v^k)a_k}{a + H(W_f^k, v^k)H^T(W_f^k, v^k)}T^k - T_0^k - H(W_f^k, v^k)\theta^k\Big),$$

where $a>0, 0<y<2, a_k$ is a dead-band parameter, $T^{k=T(W_f^k, v^k)}$ is measured torque value, and $T_0^k$ is the initial approximation of the torque value $T_0(W_f^k, v^k)$.

Figure 2:
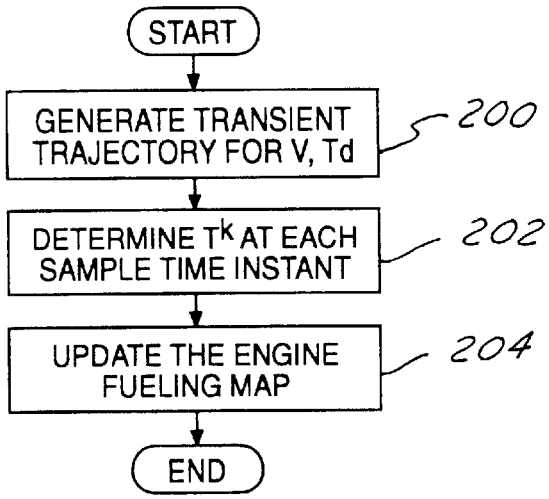
FIG. 2 is a logic flow diagram of a method of calibrating a DISC engine, according to one embodiment of the present invention.

Referring now to FIG. 2, there is shown a logic flow diagram of a method of calibrating a DISC engine according to one embodiment of the present invention. In step 200, the calibrator generates a transient trajectory for the engine by applying excitation signals. The engine parameters are represented by v such as the engine fueling rate, spark timing, intake manifold pressure, burnt gas fraction and mass flow rate through the cylinders. These values are set to generate a desired torque value $T_d$.

In step 202, the method determines the mean value of the measured engine torque at each sampling time instant, $t_k = kT$. The torque is preferably determined from a torque sensor or from in-cylinder pressure measurements and an inertia model of the engine. The measured torque value at each time instant ($T_s^k = T(W_f^k, v^k)$) is determined by applying the fueling rate $$W_f^k = W_f^0(T_d(kT), v^k) + \underline{W}_f(T_d(kT), v^k)$$

generated according to equation (6) with the current scalar parameter estimate $\lambda = \lambda_k$ generated according to equation (12). The gradient approximation of equation (14) is then updated by the projection algorithm of equation (15). In step 204, the fueling map of equation (5) is updated according to equation (12).

An example of the present method follows using a DISC engine model with zero EGR percentage. As described above, the first step develops rough initial approximations of the fueling and torque maps from available steady-state mapping data. In this case, the engine brake torque is a sum of the friction torque, pumping torque and indicated torque. The friction torque depends quadratically on the engine speed and linearly on the intake manifold pressure. The pumping torque depends linearly on the intake manifold pressure, and the indicated torque depends quadratically on the deviation of the spark value from the MBT (maximum brake torque) spark value and linearly on the fueling rate.

At a given operating condition, there is an optimal spark timing ($S_{MBT}$) which corresponds to the maximum brake torque (MBT) and thus the best fuel economy. MBT spark timing depends on engine operating variables such as engine speed, air flow, air-to-fuel ratio, EGR and injection timing. $S_{MBT}$ is used in the torque equation to normalize the effects of spark timing on engine torque. The model for $S_{MBT}$ is derived by either curve fitting the MBT spark timing data in terms of N, $P_i$, r, E, whenever N is engine speed, $p_i$ is intake manifold pressure, r is air/fuel ratio and E is the EGR percentage. Alternatively, the model is derived by regressing the engine torque as a function of N, $p_i$, r, E, s and then analytically searching for the spark timing corresponding to the maximum torque (take $$\frac{dT_b}{ds} = 0$$

and solve for s).

To ensure that the form of the engine torque representation is invertible with respect to $W_f$, the following general parameterization was used:

$$T = a_0 + a, N + a_2N^2 + a_3p_i + a_4Np_i + W_{f(b0} + b_i(s - S_{MBT})^2) \tag{16}$$

where $$b_0 = b_{01} + b_{02}N + b_{03}/N$$

$$b_1 = b_{11} + b_{12}N + b_{13}/N$$

and $$S_{MBT}=C_0+c_1N+C_2/N+C_3(W_{cyl}/W_f)$$

In this way, the inversion of this expression with respect to $W_f$ requires only solution of the quadratic equation. The corresponding torque regression is then set as $T_0(W_f, v)$.

The iterative mapping algorithm is then executed to fine tune the fueling map from transient data so that $$W_f(T_d, v)=W_{f,0}(T_d, v)+\underline{W}_f(T_d, v),$$

$$T(W_f(T_d,v), v)=T_d$$

$$\underline{W}_f(T_d, v)=\sum_{i=1}^{n}\lambda_i\Phi_i(T_d, v)$$

where $\Phi_I$ are specified basis functions such as polynomial and $\lambda_I$ is updated on-line to reduce the error:

$$\text{error}=|T(T(W_1(T_d,v),v)-T_d|$$

Figure 3A:
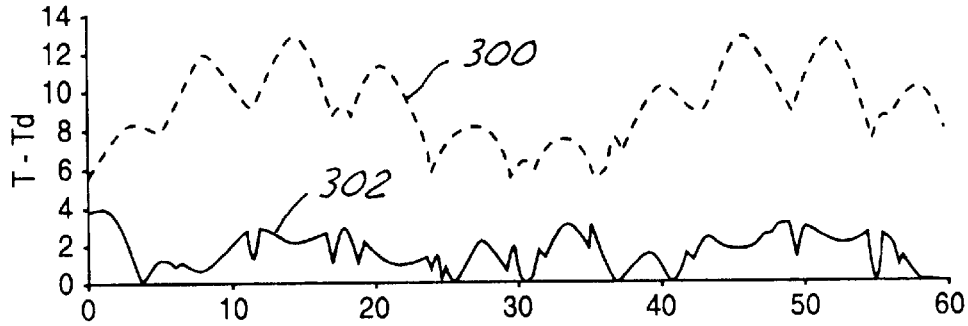
FIGS. 3A and 3B are graphs depicting the improved torque error and fueling rate of the present method.
Figure 3B:
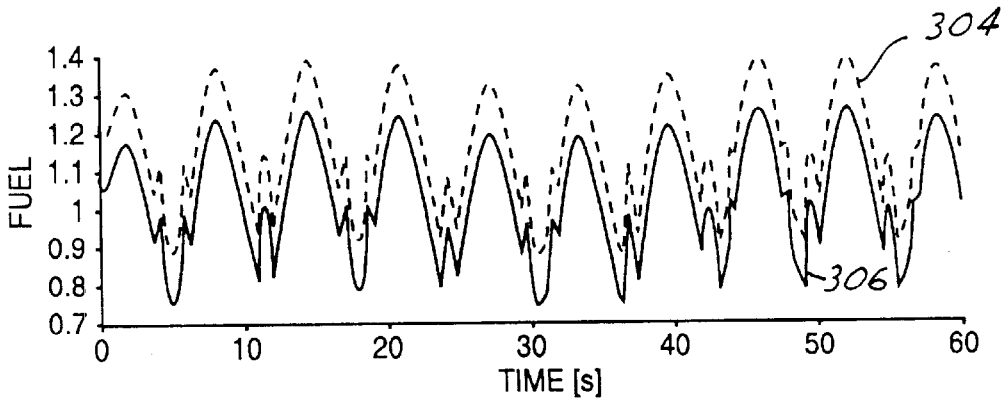

FIG. 3*a* shows the deviation of the torque output from the desired torque before the adaptation (line 300) and after the adaptation (line 302) on the trajectory used for the adaptation. The throttle and spark timing were excited periodically over the time interval of 60 seconds. As can be seen in FIG. 3*b*, the fueling rate after adaptation (line 306) was also improved as compared to before the adaptation (line 304).

From the foregoing, it can be seen that there has been brought to the art a new and improved DISC engine calibration scheme which readily allows for DISC engine control strategy development and system optimization by a model based approach. While the invention has been described in connection with one or more embodiments, it should be understood that the invention is not limited to those embodiments. For instance, the mapping method of the present invention may also be used during real-time engine operation as part of the engine control strategy. Accordingly, the invention covers all alternatives, modifications, and equivalents, as may be included within the spirit and scope of the appended claims.

What is claimed is:

1. A method of mapping DISC engine operating parameters comprising the steps of:

generating an estimated fueling rate map and torque map from engine steady-state mapping data;

generating a transient engine operating trajectory along a predetermined parameter vector; and iteratively modifying said estimated fueling rate map as a function of the generated torque resulting from said transient engine operating trajectory.

2. The method of claim 1 wherein the step of iteratively modifying said estimated fueling rate map includes the steps of, for each sampling time instant $t_k$:

applying a current estimated fueling rate associated with said estimated fueling rate map;

determining the engine torque value corresponding to said parameter vector;

updating the fueling map as a function of the engine torque value.

3. The method of claim 2 wherein the step of determining the engine torque value corresponding to said parameter vector includes the step of measuring the engine torque.

4. The method of claim 2 wherein the step of determining the engine torque value corresponding to said parameter vector includes the step of estimating the engine torque value from in-cylinder pressure measurements and an engine inertia model.

5. The method of claim 2 wherein said parameter vector includes an intake manifold pressure value, engine speed value, spark timing value, cylinder mass airflow value, and burnt gas fraction value.

6. The method of claim 1 wherein the step of generating a transient engine operating trajectory includes the step of perturbing at least one of an EGR valve position, throttle position, or fueling rate.

7. A method of developing a fueling map for a DISC engine comprising the steps of:

generating an estimated torque map ($T_0$) from engine steady-state mapping data;

inverting the torque map to generate an estimated fueling rate map ($W_{f,0}(T_d,v)$);

perturbing said engine operation by generating a transient engine operating trajectory along a predetermined parameter vector (v); and at a predetermined time sampling rate ($t_k$=kT), modifying said estimated fueling rate map at each sampling time instant as a function of a generated torque value resulting from said transient engine operating trajectory.

8. The method of claim 7 wherein the step of modifying said estimated fueling rate map includes the steps of:

applying a current estimated fueling rate associated with said estimated fueling rate map according to the following equation:

$$W_f(T_d, v)=W_{f,0}(T_d, v)+\underline{W}_f(T_d, v);$$

determining the engine torque value corresponding to said parameter vector and said fueling rate generating the fueling map ($W_f(T_d,v)$) as a function of the engine torque value and parameter vector.

9. The method of claim 8 further comprising the step of updating a gradient approximation for said engine torque value according to the following equation:

$$D_1T(W_f, v)= \tag{14}$$

$$D_1T_0(W_f, v)+\sum_{i=1}^{m}\theta_iD_1H_i(W_f, v)=D_1T_0(W_f, v)+D_1H(W_f, v)\theta.$$

where $H=(H_1, \ldots, H_m)$ is a row-vector of predefined basis functions and θ is updated at each time instant according to the following projection algorithm:

$$\theta^{k+1}=\theta^k+\Delta\theta^k, \tag{15}$$

$$\Delta\theta^k=\frac{yH^T(W_f^k, v^k)a_k}{a+H(W_f^k, v^k)H^T(W_f^k, v^k)}T^k-T_0^k-H(W_f^k,v^k)\theta^k\Big),$$

where a>0, 0<y<2, $a_k$ is a dead-band parameter, $T^k=T(W_f^k, v^k)$ is measured torque value, and $T_0^k$ is the initial approximation of the torque value $T_0(W_f^k,v^k)$.

10. The method of claim 7 wherein said generated torque value is a measured engine torque value.

11. The method of claim 7 wherein said generated torque value is an estimated engine torque value from in-cylinder pressure measurements and an engine inertia model.

12. The method of claim 7 wherein said parameter vector includes an intake manifold pressure value, engine speed value, spark timing value, cylinder mass airflow value, and burnt gas fraction value.

13. The method of claim 7 wherein the step of perturbing said engine operation includes the step of perturbing at least one of an accelerator pedal position input, exhaust gas recirculation percentage or spark timing value.

* * * * *